United States Patent [19]

Cushman

[11] Patent Number: 4,587,476

[45] Date of Patent: May 6, 1986

[54] HIGH VOLTAGE TEMPERATURE COMPENSATED FOLDBACK CIRCUIT

[75] Inventor: Glen P. Cushman, Kent, Wash.

[73] Assignee: The Boeing Company, Seattle, Wash.

[21] Appl. No.: 537,729

[22] Filed: Sep. 29, 1983

[51] Int. Cl.[4] ..... G05F 1/58; G05F 1/44

[52] U.S. Cl. ..... 323/276; 323/907

[58] Field of Search ..... 323/275, 276, 280, 303, 323/908, 273, 907; 361/57, 58, 93

[56] References Cited

U.S. PATENT DOCUMENTS

| | | | |
|---|---|---|---|
| 2,978,630 | 4/1961 | De La Tour | 323/4 |
| 3,078,410 | 2/1963 | Thomas | 323/22 |
| 3,113,260 | 12/1963 | Wiley | 323/4 |
| 3,403,320 | 9/1968 | Whitman, Jr. | 323/4 |
| 3,470,457 | 9/1969 | Howlett | 323/22 |
| 3,675,114 | 7/1972 | Nercessian | 323/275 |
| 3,711,763 | 1/1973 | Peterson | 323/276 |
| 3,735,240 | 5/1973 | Davis et al. | 323/4 |
| 3,753,079 | 8/1973 | Trilling | 323/4 |
| 3,902,111 | 8/1975 | Pfisterer, Jr. | 323/19 |
| 3,959,713 | 5/1976 | Davis et al. | 323/907 |
| 4,017,779 | 4/1977 | McDonald et al. | 323/275 |
| 4,039,900 | 8/1977 | Roback et al. | 361/388 |
| 4,095,164 | 6/1978 | Ahmed | 323/8 |
| 4,176,309 | 11/1979 | Schulz et al. | 323/4 |
| 4,327,319 | 4/1982 | Swisher et al. | 323/275 |
| 4,400,661 | 8/1983 | Duley | 323/275 |

FOREIGN PATENT DOCUMENTS

| | | | |
|---|---|---|---|
| 56-7116 | 1/1981 | Japan | 323/273 |
| 800980 | 4/1979 | U.S.S.R. | 323/276 |

OTHER PUBLICATIONS

Dobkyn, "Break Loose from Fixed IC Regulators", Electronic Design, vol. 25, No. 8, Apr. 12, 1977, pp. 118–122.

Rice, "Collector Driven Regulators", New Electronics, vol. 14, No. 9, May 5, 1981, p. 27.

*Primary Examiner*—Patrick R. Salce

*Assistant Examiner*—D. L. Rebsch

*Attorney, Agent, or Firm*—Bruce A. Kaser; Delbert J. Barnard

[57] ABSTRACT

A resistor (R3) reduces voltage between an input voltage and the emitter terminal of a series pass transistor pair (Q1, Q2). An operational amplifier (U1) compares this reduced voltage with a reference voltage that is less than, but varies with, the input voltage. The emitter voltage decreases until the current reaches a design limit. Then, a resistor senses the output voltage and pulls the operational amplifier's input voltage down. This action causes the base current of the transistor pair (Q1, Q2) to decrease and the output current to foldback.

18 Claims, 2 Drawing Figures

HIGH VOLTAGE TEMPERATURE COMPENSATED FOLDBACK CIRCUIT

DESCRIPTION

The Federal Government has rights in this invention pursuant to Contract No. 733657-81-0212 awarded by the U.S. Air Force 1. Technical Field The present invention relates to the provision of a foldback circuit which (1) can operate at high voltages, up to 80 volts, (2) can handle moderately high currents, up to 5 amps at 80 volts, (3) is very stable in performance for a wide temperature range, and (4) operates from a single power supply.

2. Background Art

Known foldback circuits use one of two methods to cause the output current to foldback under partial or short circuit conditions. The first method utilizes the internal features of a voltage regulator. An external sampling resistor is commonly placed across the base-emitter junction of a shutoff transistor and the output current is passed through the sampling resistor. As the current through the sampling resistor increases, the voltage across the sampling resistor increases. The shutoff transistor is turned on when the resistor voltage reaches the transistor turn on voltage. As the transistor turns on, it pulls the output voltage of the regulator down and the output current decreases or folds back. However, in this type of device, the turn-on voltage of the transistor changes considerably with temperature, causing a foldback current also to change considerably with temperature.

The second known method uses a series pass transistor in place of the voltage regulator. As the shutoff transistor turns on, the base current to the series pass transistor is reduced, and this in turn reduces the output current. This method suffers from the same temperature dependence as the first method described above. A variation to this second method uses a second base-emitter junction as temperature compensation for the first. However, this method requires a second power supply of higher voltage. Foldback circuits of this type are disclosed in the Fairchild Semiconductor Linear Integrated Circuits Applications Handbook, copyrighted 1967, on pages 144–146.

Examples of known regulator circuits in the patent literature which include transistors and/or operational amplfiers are shown by the following U.S. Pat. Nos. 2,978,630, granted Apr. 4, 1961, to Roger Boy de la Tour; 3,078,410, granted Feb. 19, 1963, to James L. Thomas; 3,113,260, granted Dec. 3, 1963, to Frank L. Wiley; 3,403,320, granted Sept. 24, 1968, to Allen Lee Whitman; 3,470,457, granted Sept. 30, 1969, to Donald L. Howlett; 3,735,240, granted May 22, 1973, to William F. Davis et al; 3,753,079, granted Aug. 14, 1973, to Ted R. Trilling; 3,902,111, granted Aug. 26, 1975, to George J. Pfisterer, Jr.; 4,039,900, granted Aug. 2, 1977, to Donald W. Roback et al; 4,095,164, granted June 13, 1978, to Adel Abdel Aziz Ahmed; and 4,176,309, granted Nov. 27, 1979, to Alfred Schulz et al.

The circuits disclosed by the above publication and patents should be carefully considered for the purpose of putting the present invention into proper perspective relative to the prior art.

DISCLOSURE OF THE INVENTION

In accordance with the present invention, a protective circuit is located in a primary conductor path between a voltage source and a load. The circuit comprises shutoff circuitry including transistor means and control circuitry for the shutoff circuitry including an operational amplifier. The operational amplifier is connected to operate the shutoff circuitry in response to a load demand which exceeds the current limit of the protective circuit. The operational amplifier decreases the base current of the transistor means and causes the output current to fold back.

According to an aspect of the invention, the +V terminal of the operational amplifier is connected to input voltage and the −V terminal is connected to ground. The output of the operational amplifier is connected to the base of the transistor means.

According to another aspect of the invention, a voltage divider that is powered by the input voltage is connected to provide a reference voltage at the noninverting input of the operational amplifier. The reference voltage is lower than but varies directly with the input voltage.

According to a further aspect of the invention, a current limit establishing resistor is positioned between the input terminal of the circuit and the shutoff circuitry. The current pass limiting resistor establishes an input voltage to the shutoff circuitry and also establishes the current limit of the circuit. That is to say, the resistance value of the current limit establishing resistor establishes the current pass limit of the circuit, i.e. the current value at which current pass stops and foldback starts.

In accordance with an aspect of the invention, a second voltage divider is connected to apply to the inverting input of the operational amplifier, a fraction of the input voltage to the shutoff circuitry.

In accordance with another aspect of the invention, a resistor is located in a conductive path which extends from the output of the circuit to the output junction of the second voltage divider. This resistor senses the output voltage when the load demand exceeds the current limit and at that time functions to pull down the voltage to the inverting input of the operational amplifier.

In accordance with a further aspect of the invention, superior foldback performance is obtained over a wide temperature range because of the use of the operational amplifier. In addition, the use of operational amplifier, such as the LM144 amplifier, allows the circuit to operate at high voltages from a single power supply.

The reason that terminal stability is obtained by use of the operational amplifier is that the operational amplifier has a high dc gain (60,000–100,000) which negates the temperature variations of the transistor gain. Although the operational amplifier gain will vary with temperature, it will remain large enough to have essentially no effect on circuit performance.

Thus, the only variations in performance over a temperature range will be due to temperature coefficient differences of the resistors in the circuit which are typically very small.

Accordingly, it is an object of the invention to provide an improved foldback circuit which can operate at high voltages, up to 80 volts, and can handle moderately high currents, up to 5 amps at 80 volts.

It is another object of the invention to provide a foldback circuit which performs in a very stable manner over a wide temperature range.

Yet another object of the invention is to provide a foldback circuit which can operate at high voltages, and which is very stable over a wide temperature range, and which in addition operates from a single power supply.

Other objects, features and advantages of the invention are set forth in the detailed description of the best mode of the invention.

BEST MODE FOR CARRYING OUT THE INVENTION

Figure 1:
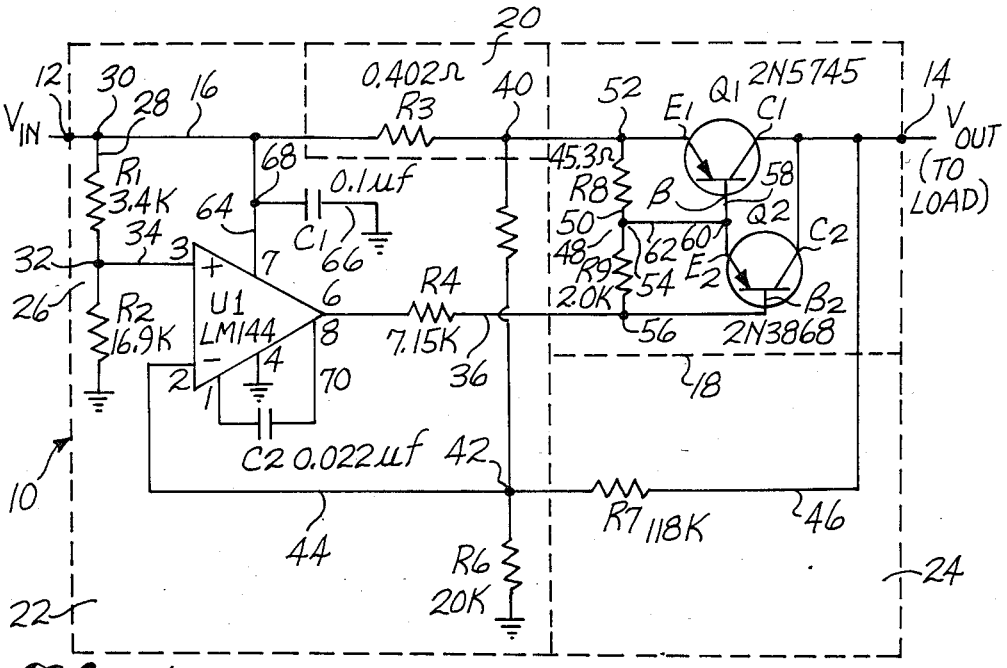
FIG. 1 is a circuit diagram of a high voltage, temperature compensated foldback circuit, embodying the present invention.

Referring to FIG. 1, the circuit 10 includes an input terminal 12 and an output terminal 14. The input terminal 12 is connected to a direct current power supply hereinafter referred to as the input voltage. A first or primary conductor path 16 extends between the input terminal 12 and the output terminal 14. Path 16 includes shutoff circuitry 18. The other basic parts of the circuit are a current-limit establishing means 20, shutoff control circuitry 22 and a load sensor means 24.

The control circuitry 22 includes an operational amplifier U1. In preferred form, the operational amplifier is a LM144 amplifier.

A first voltage divider 26, powered by the input voltage, is connected to provide a reference voltage at the noninverting input terminal of the operational amplifier U1. This reference voltage is less than but varies directly with the input voltage. For proper circuit operation, this reference voltage should be at least two volts lower than the input voltage.

Voltage divider 26 includes a conductor path which is herein referred to as the second conductor path. It includes in series a first junction 30 in the primary conductor path 16, a resistor R1, a second junction 32, a resistor R2, and a ground connection. A conductor path, herein referred to as the third conductor path, connects junction 32 to the terminal 3.

The +V terminal 7 of the operational amplifier U1 is connected to input voltage. The −V terminal 4 is connected to ground. Thus, the entire circuit is powered by a single power source.

In the illustrated example, the current level establishing means 20 comprises a resistor R3 connected in series between the input terminal 12 and the input to the shutoff circuitry. The value of resistor R3 determines the current pass limit of the circuit. Resistor R3 samples the current passing through the circuit and establishes the emitter voltage for a series pass transistor Q1. A second voltage divider applies a fraction of this emitter voltage to the operational amplifier's inverting input terminal 2.

A conductor path 36, herein termed the fourth conductor path, extends from the output terminal 6 of the operational amplifier U1 to the base of transistor Q2.

The second voltage divider comprises a fifth conductive path 38, including a third junction 40 in the primary conductor path 16, located between resistor R3 and the emitter of transistor Q1. The second voltage divider also includes a fifth resistor R5, a fourth junction 42, a sixth resistor R6, and a ground connection. A sixth conductor path 44 extends from the junction 42 to the inverting input terminal 2 of the operational amplifier U1.

A seventh conductor path 46 connects junction 42 with the primary conductor path 16, between the shutoff circuitry 18 and the output terminal 14. An output sensing resistor R7 is located in conductor path 46. Resistor R7 makes up the load sensing portion 24 of the circuit 10. Resistor R7 functions to pull down the voltage to the inverting input 2 when the load demand exceeds the current limit. In other words, resistor R7 replaces resistor R3 when the current limit has been reached and the output current is folding back.

The shutoff circuitry comprises a Darlington pair of PNP transistors Q1, Q2. Transistor Q1 has an emitter terminal E1 connected to conductor path 16, to receive the voltage established by resistor R3. It also includes a collector terminal C1 which is connected the circuit output and a base terminal B1. Transistor Q2 includes an emitter terminal E2, a base terminal B2 and a collector terminal C2. Conductor path 36 extends from the output 6 of the operational ammplifier U1 to the base terminal B2. Collector terminal C2 is connected to the output of the circuit 10.

A third voltage divider 48 provides a voltage to the base B1 and the emitter E2 which is a fraction of the voltage to emitter E1. Voltage divider 48 includes a conductor path 50, which is herein referred to as the eighth conductor path. It includes in series a fifth junction 52, a resistor R8, a sixth junction 54, a resistor R9, and a seventh junction 56. Junction 56 is in conductor path 36.

The resistors R8 and R9 prevent leakage current from passing through the base-emitter junctions of Q1 and Q2 respectively when the transistors are turned off.

A ninth conductor path 58 extends between the base terminal B1 of transistor Q1 and the emitter terminal E2 of the transistor Q2. A tenth conductor path 62 connects junction 54 to a junction 60 in conductor path 58.

An eleventh conductor path 64 is innerconnected between the input voltage region of the primary conductor path 16 and the +V terminal 7 of the operational amplifier U1. A twelveth conductor path 66 is connected to conductor path 64 at a junction 68. Conductor path 66 includes in series, the junction 68, a capacitor C1 and a ground connection.

A thirteenth conductor path 70 is innerconnected between the balance terminal 1 and the compensation terminal 8 of the operational amplifier U1. A second capacitor C2 is located in conductor path 70.

The use of the operational amplifier U1 to sample the current that has passed through the circuit provides a superior foldback performance over a wide temperature range. In addition, the use of a LM144 operational amplifier, or the equivalent, allows the circuit to operate at high voltages from a single power supply.

The temperature stability is provided by the operational amplifier. Its high dc gain (about 60,000–100,000) negates the temperature variations of the transistor gain. The operational amplifier gain will vary with temperature. However, the gain will remain large enough to have essentially no effect on circuit performance, and the only temperature variations will be due to differences in resistor temperature coefficients.

Figure 2:
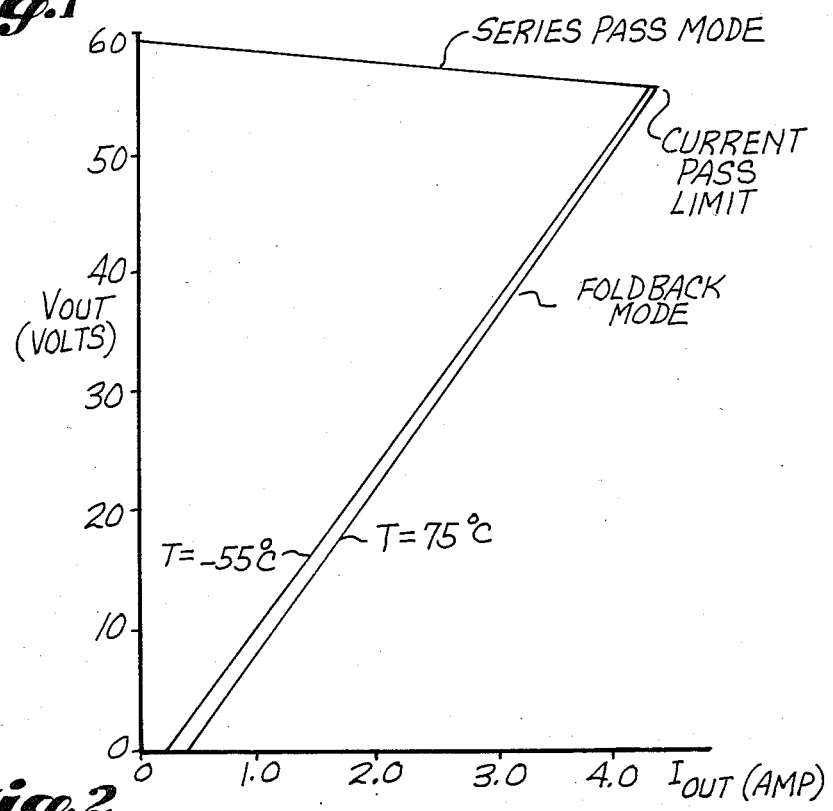
FIG. 2 is a plot of a output voltage verses output current, showing the performance of the circuit shown by FIG. 1 over the −55° C. to 75° C. temperature range.

FIG. 2 shows performance of the illustrated example circuit 10 over the −55° C. to 75° C. temperature range. FIG. 2 clearly shows that the circuit operation is not greatly affected by changes in temperature.

In the series pass region of operation, the circuit 10 acts about the same as a 0.8 ohm resistor. In the foldback region, circuit performance is approximated by the transfer function:

$$I_{OUT} = V_{IN} \times \frac{((R1 + R2) \times (R6 \times R7)) - (R2 \times ((R5 \times R6) + (R5 \times R7) + (R6 \times R7)))}{R6 \times (R1 + R2) \times ((R3 \times R7) - (R5 \times RLOAD))}$$

High precision resistors should be used for R1, R2, R5, R6, and R7 because they determine the short circuit current and the slope of the foldback curve in the foldback region, according to the transfer function shown above. Output voltage stability is achieved by placing the capacitor C2 between the compensation pins 1 and 8 of the operational amplifier U1. If a LM144 operational amplifier is used, the foldback can operate at voltages up to 80 V. This is made possible by connecting the negative supply pin 4 of the operational amplifier U1 to ground and the positive supply pin 7 to the input voltage. Only one power supply is required. The current required to place the circuit in the foldback region will increase with voltage. This will eliminate power drop outs due to voltage transients.

The following is a table of values for the components of the example circuits shown by FIG. 1:

| | | | |
|---|---|---|---|
| C1: | 0.1 uF ± 10%, 100 V | R4: | 7.15KΩ ± 1%, 1/10 W |
| C2: | 0.022 pF ± 10%, 50 V | R5: | 3.4KΩ ± .005%, 3/10 W |
| Q1: | 2N5745 | R6: | 20KΩ ± .005%, 3/10 W |
| Q2: | 2N3868 | R7: | 118KΩ ± .1%, 1/10 W |
| R1: | 3.4KΩ ± .005%, 3/10 W | R8: | 45.3KΩ ± 1%, 1/10 W |
| R2: | 16.9KΩ ± .005%, 3/10 W | R9: | 2.0KΩ ± 1%, 1/10 W |
| R3: | .402Ω ± 1%, 3 W | U1: | LM144 |

The foldback circuit 10 can provide protection for unregulated, high voltage outputs that require a stable shutoff point over a wide temperature range. In addition, the circuit 10 can be easily modified to operate over a wide range of voltage/current levels. For instance, higher or lower voltage operational amplifiers may be used in place of the LM144, or other transistor arrangements may be used, depending on circuit requirements.

What is claimed is:

1. A foldback circuit, comprising:

a first conductor path including in series, an input terminal connectable to a direct current power supply, shutoff circuitry including transistor means, and an output terminal connectable to a load; and control circuitry for the shutoff circuitry including an operational amplifier connected to operate the shutoff circuitry in response to a load demand which exceeds a current pass limit, to decrease the base current of the transistor means and cause the output current to foldback, said operational amplifier including a +V terminal connected to input voltage, a −V terminal connected to ground, an output terminal connected to the base of the transistor means, a noninverting input terminal, means powered by the input voltage and connected to provide a reference voltage at the noninverting input terminal which is less than but varies directly with the input voltage, an inverting input terminal, a conductor extending from a point in the first conductor path ahead of the shutoff circuitry to the inverting input terminal, and a foldback conductor extending from a point in the first conductor path between the shutoff circuitry and the output terminal to the inverting input terminal.

2. A foldback circuit according to claim 1, comprising a current pass limit resistor in the first conductor path ahead of the point of connection of the conductor which extends from a point in the first conductor path ahead of the shutoff circuitry to the inverting input, and a foldback resistor in the foldback conductor, said resistors determining the current pass limit of the circuit, and said foldback resistor replacing the current pass limit resistor when a predetermined current limit has been reached and the output current is folding back.

3. A foldback circuit according to claim 1, wherein the operational amplifier is a LM144 amplifier.

4. A foldback circuit, comprising:

a first conductor path including in series, an input terminal connectable to a direct current power supply, shutoff circuitry including transistor means, and an output terminal connectable to a load;

control circuitry for the shutoff circuitry including an operational amplifier connected to operate the shutoff circuitry in response to a load demand which exceeds a current pass limit, to decrease the base current of the transistor means and cause the output current to foldback, said operational amplifier including a +V terminal connected to input voltage, a −V terminal connected to ground, and an output terminal connected to the base of the transistor means, a first voltage divider powered by the input voltage and connected to provide a reference voltage at the noninverting input terminal of the operational amplifier which is less than but varies directly with the input voltage;

a current limit establishing third resistor in the first conductor path in series between the input terminal and the shutoff circuitry, to establish an input voltage to the shutoff circuitry and establish the current limit of the circuit, and a second voltage divider connected to apply a fraction of the input voltage to the shutoff circuitry to the inverting input terminal of the operational amplifier.

5. A foldback circuit according to claim 4, comprising a fourth conductor path extending between the output of the operational amplifier and the base of the transistor means, and a fourth resistor in said fourth conductor path.

6. A foldback circuit according to claim 4, wherein the second voltage divider comprises a fifth conductor path including in series a third junction in the first conductor path, located between the current limit establishing third resistor and the shutoff circuitry, a fifth resistor, a fourth junction, a sixth resistor, and a ground, and a sixth conductor path extending from said fourth junction to the inverting input terminal of the operational amplifier.

7. A foldback circuit according to claim 6, comprising a seventh conductor path extending between the fourth junction and the output of the circuit, said seventh conductor path including an output sensing seventh resistor which senses the output voltage when the load demand exceeds the current limit, said output sensing seventh resistor functioning to pull down the voltage to the inverting input of the operational amplifier.

8. A foldback circuit according to claim 5, wherein the transistor means comprises a Darlington pair of PNP transistors.

9. A foldback circuit according to claim 8, wherein said Darlington pair of transistors comprises a first transistor having an emitter terminal connected to receive the input voltage to the shutoff circuitry, a collector terminal connected to the output, and a base, wherein the second transistor includes an emitter connected to the base of the first transistor, a collector connected to the output, and a base, wherein said fourth conductor path extends between the output of the operational amplifier and the base of the second transistor, and a third voltage divider comprising an eighth conductor path extending between the first conductor path and the fourth conductor path, and including in series a fifth junction in said first conductor path, an eighth resistor, a sixth junction, a ninth resistor, and a seventh junction in the fourth conductor path, and a ninth conductor path extending between the base of the first transistor and the emitter of the second transistor, an eighth junction in said ninth conductor path, and a tenth conductor path extending between the sixth and seventh junctions.

10. A foldback circuit according to claim 9, comprising an eleventh conductor path innerconnected between an input voltage region of the first conductor path and the +V terminal of the operational amplifier, and a twelfth conductor path including in series, a seventh junction in the eleventh conductor path, a first capacitor, and a ground.

11. A foldback circuit according to claim 10, comprising a thirteenth conductor path connected between the balance terminal and the compensation terminal of the operational amplifier, and a second capacitor in said thirteenth conductor path.

12. A foldback circuit according to claim 2, wherein the operational amplifier is a LM144 amplifier.

13. A foldback circuit, comprising:

an input terminal connectable to a direct current power supply;

an output terminal connectable to a load;

shutoff circuitry between the input and output terminals, including transistor means;

a current limit establishing resistor between the input terminal and the shutoff circuitry, to establish an input voltage to the shutoff circuitry on a current pass limit;

control circuitry for the shutoff circuitry including an operational amplifier connected to operate the shutoff circuitry in response to a load demand which exceeds the current pass limit, to decrease the base current of the transistor means and cause the output current to fold back;

a first voltage divider powered by the input voltage and connected to provide a reference voltage at the noninverting input of the operational amplifier which is lower than but varies directly with the input voltage;

a second voltage divider powered by the emitter voltage and including an output junction connected to provide a voltage signal to the inverting input of the operational amplifier; and conductor means connected between the output junction of the second voltage divider and an output region of the circuit, said conductive path including an output sensing seventh resistor which senses the output voltage and pulls down the voltage to the inverting input of the operational amplifier when the load demand exceeds the current pass limit.

14. A foldback circuit according to claim 13, wherein the operational amplifier is a LM144 amplifier.

15. A foldback circuit according to claim 13, wherein a capacitor is provided within a conductor path which extends between the balance terminal and the compensation terminal of the operational amplifier.

16. A foldback circuit according to claim 13, wherein the transistor means comprises a Darlington pair of PNP transistors.

17. A foldback circuit according to claim 16, wherein said transistor means comprises a 2N5745 transistor, connected to receive the emitter voltage, paired with a 2N3868 transistor.

18. A foldback circuit according to claim 17, wherein the operational amplifier is a LM144 amplifier.

* * * * *

UNITED STATES PATENT AND TRADEMARK OFFICE

CERTIFICATE OF CORRECTION

PATENT NO. : 4,587,476

DATED : May 6, 1986

INVENTOR(S) : Glen P. Cushman

It is certified that error appears in the above-identified patent and that said Letters Patent are hereby corrected as shown below:

In the Abstract, page 1, line 9, "pulls" should be -- functions to pull --.

Column 1, line 8, "733657-81-0212" should be -- F33657-81-C-0212 --.

Column 1, line 50, "amplfiers" should be -- amplifiers --.

Column 4, line 15, after the word "connected" add the word -- to --.

Column 4, line 19, "ammplifier" should be -- amplifier --.

Column 4, line 40, "twelveth" should be -- twelfth --.

Column 5, line 39, "levels" should be -- ranges --.

Signed and Sealed this

*Sixteenth* Day of *September 1986*

[SEAL]

*Attest:*

DONALD J. QUIGG

*Attesting Officer*

*Commissioner of Patents and Trademarks*